United States Patent [19]

Wagner

[11] Patent Number: 4,824,062

[45] Date of Patent: Apr. 25, 1989

[54] CURTAIN ROD AND END BRACKET ASSEMBLY

[75] Inventor: John S. Wagner, Madison, Wis.

[73] Assignee: Graber Industries, Inc., Middleton, Wis.

[21] Appl. No.: 236,610

[22] Filed: Aug. 25, 1988

[51] Int. Cl.[4] ..... A47H 1/10

[52] U.S. Cl. ..... 248/265; 211/105.1; 16/94 R

[58] Field of Search ..... 248/265, 261, 262, 269, 248/257, 251, 254, 201; 211/105.1, 105.3; 160/902; 16/94 R

[56] References Cited

U.S. PATENT DOCUMENTS

| | | | |
|---|---|---|---|
| 2,680,589 | 6/1954 | Nelson | 248/264 |
| 4,235,406 | 11/1980 | Vecchiarelli | 160/902 X |
| 4,352,433 | 10/1982 | Ford | 211/105.1 |
| 4,580,753 | 4/1986 | Hennequin | 160/902 X |
| 4,635,889 | 1/1987 | Bell et al. | 248/257 X |

OTHER PUBLICATIONS

Publication "Dauphine Curtain Rod," Form No. 5510x01 by Graber Industries, Inc., published about 1985.

*Primary Examiner*—Ramon O. Ramirez
*Attorney, Agent, or Firm*—Vernon J. Pillote

[57] ABSTRACT

A curtain rod of the type having a wide flat front wall and upper and lower U-shaped flanges extending lengthwise along the rear side of the front wall. The rod is supported at its end by L-shaped corner brackets having an upright rod support panel and a mounting panel that extends rearwardly from the rod support panel and integral therewith. The rod support panel is constructed and arranged to extend into the upper flange on the rod member and support the rod member for limited pivotal movement about the upper edge of the support panel, and a latch is provided on the rod support panel at a location to engage the rod member and releasably retain the rod alongside the rod support panel.

12 Claims, 1 Drawing Sheet

Fig. 1.
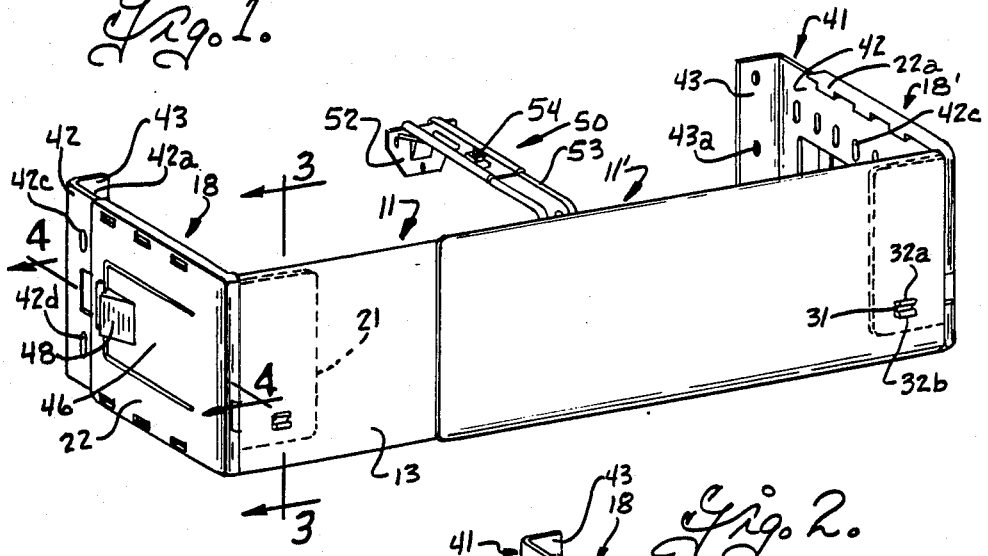
Fig. 2.
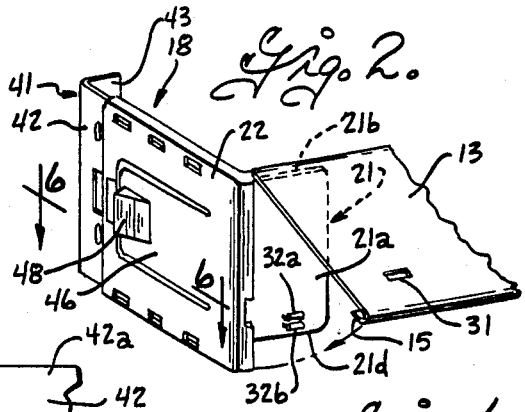
Fig. 3.
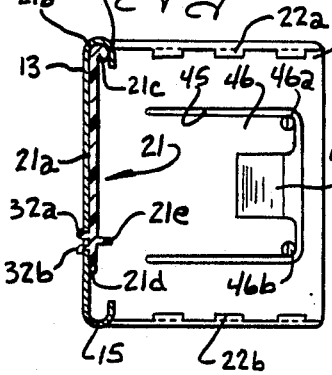
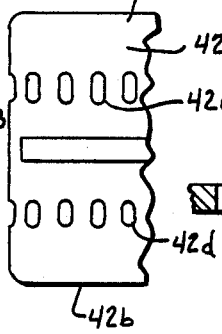
Fig. 6.
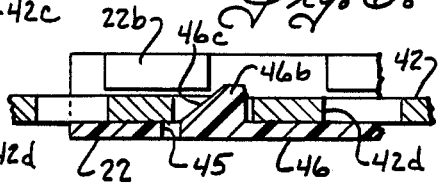
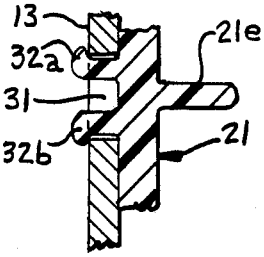
Fig. 4.
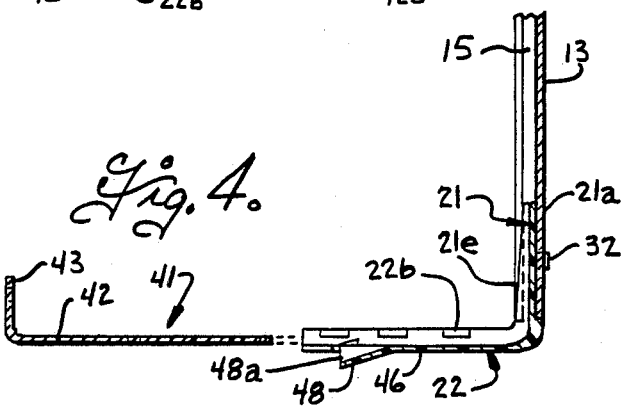
Fig. 5.

CURTAIN ROD AND END BRACKET ASSEMBLY

BACKGROUND OF THE INVENTION

The present invention relates to curtain rods and rod end brackets therefor and particularly to curtain rods having a relatively wide front wall and upper and lower U-shaped flanges extending lengthwise along the rear side of the front wall, with brackets for supporting the rod member with the front wall in a generally upright plane. U.S. Pat. No. 4,352,433 discloses a rod of this type in which end caps are pressed in a direction lengthwise of the rod member into the end thereof and the end caps are formed with upper and lower openings for engaging upper and lower hooks on an end bracket. The rod member with the end caps inserted into the ends, can be assembled on the upper and lower hooks of the end bracket from the front of the rod. However, this construction not only required production and assembly of the rod end cap as a separate piece from the rod end bracket, but also required accurate adjustment of the length of the rod to properly position the end caps relative to the hooks on the end brackets, prior to mounting the rod on the end brackets.

The assignee of the present invention has also manufactured and sold wide face rods in which the rod end brackets were formed with upper and lower prongs that extended laterally from the forward end of the rod end brackets, and which were adapted to be pressed in a direction lengthwise of the rod into the upper and lower flanges at the rear side of the rod member. This arrangement did not utilize separate end caps on the ends of the rod member for attaching the rod member to the rod end brackets. However, assembly of the rod member on the end brackets required relative movement of the rod member and the rod end brackets in a direction paralleling the length of the rod member and prongs on the rod end bracket, and this made it somewhat difficult to assemble the rod member on the end bracket, particularly after the end bracket was mounted on a supporting surface.

In the assignee's prior wide face curtain rod and end bracket assembly, the rod end bracket was adjustably mounted on a wall bracket to enable adjustment of the projection of the rod member from the wall. The wall bracket had a row of openings and the rod end bracket overlied the outer face of the wall bracket and had an integral tongue with bosses adapted to engage in selected ones of the openings in the row of openings in the wall bracket, to lock the end bracket in a desired adjusted position on the wall bracket. Movement of the tongue to a position to release the bosses from the openings could only be effected by pressing outwardly on a tab located at the inner side of the end bracket, and some difficulty was encountered in adjusting the end bracket on the wall bracket.

SUMMARY OF THE INVENTION

It is an object of the present invention to overcome disadvantages of the prior art by providing a curtain rod and bracket assembly having a one-piece corner bracket and in which the rod member can be mounted directly on the corner bracket from the front of the assembly.

Another object of this invention is to provide a curtain rod and bracket assembly in accordance with the foregoing object, and which has an improved arrangement to facilitate mounting and adjustment of the rod corner bracket on a wall bracket.

Accordingly, the present invention provides a curtain rod and bracket assembly comprising at least one elongated rod member having a front wall and upper and lower U-shaped flanges extending lengthwise along a rear side of the front wall, corner bracket means having a generally upright rod support panel means and a generally upright mounting panel means extending rearwardly from the rod support panel means and integral therewith. The rod support panel means has a front face adapted to engage the rear side of the front wall of the rod member, and the rod support panel means has upper edge means and is constructed and arranged to extend into the upper flange on the rod member adjacent one end thereof and support the rod member for limited pivotal movement about the upper edge means toward and away from the front face of the rod support panel means. Latch means is provided on the rod support panel means below the upper edge means and is engageable with the rod member when the latter is pivoted about the upper edge means into engagement with the front face of the rod support panel for releasably retaining the rod member against pivotal movement away from the front face of the rod support panel. The latch means is advantageously formed integrally with the front face of the rod support panel and arranged to extend through a latch opening in the front wall of the rod member, to releasably latch the rod member to the front panel.

BRIEF DESCRIPTION OF THE DRAWINGS

FIG. 1 is a perspective view of a curtain rod and bracket assembly embodying the present invention;

FIG. 2 is a fragmentary perspective view illustrating assembly of the rod member on the rod corner brackets;

FIG. 3 is a fragmentary vertical sectional view taken on the plane 3—3 of FIG. 1;

FIG. 4 is a fragmentary horizontal sectional view taken on the plane 4—4 of FIG. 1 and illustrating the corner bracket disassembled from the mounting bracket;

FIG. 5 is a fragmentary sectional view taken on the plane 3—3 of FIG. 1 and illustrating parts on a larger scale; and FIG. 6 is a fragmentary sectional view taken on the plane 6—6 of FIG. 2.

DETAILED DESCRIPTION

The present invention relates to a wide face rod and end bracket assembly for supporting curtains, draperies, valances and the like, hereinafter generally referred to as a curtain rod and bracket assembly. The curtain rod can be formed of a single rod member for a fixed length curtain rod but is preferably composed of telescopically adjustable inner and outer rod members 11, 11' to enable adjustment of the overall length of the curtain rod. The inner and outer rod members 11, 11' are of like construction and each include a wide generally flat front wall 13 and upper and lower U-shaped flanges 14, 15 extending lengthwise along the rear side of the front wall. The rod members are preferably formed of sheet metal with roll formed flanges.

The rod members 11, 11' are supported adjacent opposite ends by left and right corner brackets designated 18, 18'. The left and right corner brackets are mirror images of each other, with small differences in size in some portions to correspond to the slightly different cross-sectional size of the inner and outer rod members, and like numerals are used to designate corresponding parts. The corner brackets have an L-shaped configuration and each include a generally upright rod support panel 21 and a generally upright mounting panel 22 extending laterally from one end of the rod support panel and formed integrally therewith. The corner brackets are preferably molded of synthetic resin material and may, for example, be formed of medium impact ABS. The rod support panel has a front face 21*a* adapted to engage the rear side of the front wall of the rod member and an upper edge means 21*b* that is constructed and arranged to extend into the upper flange 14 on the associated rod member adjacent one end. The rod support panel 21 is adapted to support the associated rod member for limited swinging movement about the upper edge means 21*b*, toward and away from the front face of the rod support panel. The lower edge 21*d* of the rod support panel is spaced below the upper edge a distance less than the spacing between the upper and lower flanges on the rod member, to provide clearance for the lower flange 15 on the rod member, during swinging of the rod member toward and away from the front panel. As best shown in FIG. 3, the upper U-shaped flange 14 on the rod member has a width somewhat greater than the thickness of the rod support panel 21, and a flange 21*c* is provided along the edge 21*b* at the rear side of the rod support panel, to engage the rear flange 14 and retain the upper portion of the rod member adjacent the front face of the rod support panel, when the rod member extends alongside the rod support panel.

A latch means is provided on the rod support panel 21 at a location spaced below the upper edge 21*b* and is arranged to engage the rod member when the latter is pivoted about the upper edge into engagement with the front face of the rod support panel, to releasably retain the rod member against pivotal movement away from the front face of the rod support panel. For this purpose, the rod members are each formed with a latch opening 31 at a location spaced below the upper flange 14 and inwardly of the end of the rod member, and latch means 32 are formed integrally with the rod support panel and extend forwardly from the front face 21*a* at a location to extend through the latch opening 31 and engage the rod member adjacent the opening, when the rod member is positioned alongside the rod support panel As best shown in FIG. 5, the latch means 32 advantageously comprise upper and lower latch members 32*a* and 32*b* formed integrally with the rod support panel 21 and arranged to engage upper and lower edges of the latch opening 31 in the rod member. A reinforcing rib 21*e* is provided at the rear side of the rod support panel 21 at a level adjacent the latch means 32 and arranged to extend to the mounting panel 22 to stiffen the rod support panel in the area of the latch means.

The curtain rod is adjustably mounted on wall brackets 41 adapted for attachment into a supporting surface such as a wall, window casing or the like. The wall brackets 41 are of like construction and each include a generally upright bracket plate 42 and a mounting flange 43 at one end of the bracket plate. The mounting flange has openings 43*a* for receiving fasteners to attach the mounting plate to a supporting surface such as a wall. The bracket plate 42 extends generally perpendicular to the wall and has parallel upper and lower edges 42*a*, 42*b* and upper and lower rows of spaced openings 42*c* and 42*d* paralleling the upper and lower edges. The mounting panels 22 of each corner bracket are adapted to overlie the outer side of the associated one of the bracket plates and the mounting panels have upper and lower L-shaped guide flanges 22*a* and 22*b* along their upper and lower edges arranged to engage the upper and lower edges of the bracket plate to guidably support the mounting panel on the bracket plate. The mounting panels each have a U-shaped slot 45 molded therein intermediate the upper and lower flanges 22*a*, 22*b* and which defines a tongue portion 46 that is integrally joined only at one end to the mounting panel. The tongue portion extends rearwardly on the mounting panel and is normally disposed coplanar therewith and the tongue portion has upper and lower bosses 46*a* and 46*b* that extend from the distal end of the tongue portion at the inner side of the mounting panel and which are adapted to engage a selected opening in the rows of openings 42*c*, 42*d*.

The tongue 46 is formed with a finger receiving tab 48 adjacent the distal end thereof and which projects from the outer side of the mounting panel, to enable pulling of the distal end of the tongue laterally outwardly relative to the mounting panel to disengage the bosses 46*a*, 46*b* from the openings in the bracket plate. The finger receiving tab 48 is advantageously formed so as to diverge rearwardly from the outer side of the tongue toward the distal end thereof to facilitate drawing the hem of a curtain rearwardly thereover, and the tab has its rear edge spaced outwardly from the outer face of the mounting panel to provide a finger receiving opening 48*a* at the rear end of the tab. Thus, a finger can be inserted into the opening 48*a* to engage the tab and move the distal end of the tongue laterally outwardly to disengage the bosses 46*a*, 46*b* from the openings in the bracket plate. The corner bracket can then be adjusted by pulling or pushing on the corner bracket. In order to facilitate assembly of the corner brackets on the wall brackets and also facilitate inward adjustment of the corner brackets, the bosses 46*a*, 46*b* are advantageously beveled or formed with a ramp portion best shown at 46*c* in FIG. 6, and so arranged that they will cam the bosses out of the openings in the row of openings in the bracket plate, when the corner bracket is pressed rearwardly relative to the bracket plate.

An intermediate support bracket 50 is advantageously provided, particularly for long curtain rods. The intermediate bracket has a wall mounting flange 52 and a rod engaging portion 53 that terminates in an upwardly opening hook (not shown) adapted to engage the upper flange on the rod members. The rod engaging portion 53 is adjustable as by a slot and fastener arrangement 54 to enable adjustment of the projection of the rod engaging portion.

From the foregoing it is thought that the construction and installation of the rod and bracket assembly will be readily understood. The wall brackets 41 and the intermediate bracket 51 are mounted on a supporting surface such as a wall, window casing or the like, and the corner brackets 18, 18' can then be assembled onto the bracket plates of the associated wall bracket. The curtain rod composed of telescoping rod members 11, 11' is initially adjusted lengthwise to the approximate finished length required. The rod is mounted from the front by first hooking the upper flange on the intermediate support bracket and thereafter resting the upper flange at the ends of the rod members on the upper edge 21*b* of the rod support panels 21, as shown in FIG. 2. The upper edges 21*b* of the rod support panels 21 provide

CURTAIN ROD AND END BRACKET ASSEMBLY

BACKGROUND OF THE INVENTION

The present invention relates to curtain rods and rod end brackets therefor and particularly to curtain rods having a relatively wide front wall and upper and lower U-shaped flanges extending lengthwise along the rear side of the front wall, with brackets for supporting the rod member with the front wall in a generally upright plane. U.S. Pat. No. 4,352,433 discloses a rod of this type in which end caps are pressed in a direction lengthwise of the rod member into the end thereof and the end caps are formed with upper and lower openings for engaging upper and lower hooks on an end bracket. The rod member with the end caps inserted into the ends, can be assembled on the upper and lower hooks of the end bracket from the front of the rod. However, this construction not only required production and assembly of the rod end cap as a separate piece from the rod end bracket, but also required accurate adjustment of the length of the rod to properly position the end caps relative to the hooks on the end brackets, prior to mounting the rod on the end brackets.

The assignee of the present invention has also manufactured and sold wide face rods in which the rod end brackets were formed with upper and lower prongs that extended laterally from the forward end of the rod end brackets, and which were adapted to be pressed in a direction lengthwise of the rod into the upper and lower flanges at the rear side of the rod member. This arrangement did not utilize separate end caps on the ends of the rod member for attaching the rod member to the rod end brackets. However, assembly of the rod member on the end brackets required relative movement of the rod member and the rod end brackets in a direction paralleling the length of the rod member and prongs on the rod end bracket, and this made it somewhat difficult to assemble the rod member on the end bracket, particularly after the end bracket was mounted on a supporting surface.

In the assignee's prior wide face curtain rod and end bracket assembly, the rod end bracket was adjustably mounted on a wall bracket to enable adjustment of the projection of the rod member from the wall. The wall bracket had a row of openings and the rod end bracket overlied the outer face of the wall bracket and had an integral tongue with bosses adapted to engage in selected ones of the openings in the row of openings in the wall bracket, to lock the end bracket in a desired adjusted position on the wall bracket. Movement of the tongue to a position to release the bosses from the openings could only be effected by pressing outwardly on a tab located at the inner side of the end bracket, and some difficulty was encountered in adjusting the end bracket on the wall bracket.

SUMMARY OF THE INVENTION

It is an object of the present invention to overcome disadvantages of the prior art by providing a curtain rod and bracket assembly having a one-piece corner bracket and in which the rod member can be mounted directly on the corner bracket from the front of the assembly.

Another object of this invention is to provide a curtain rod and bracket assembly in accordance with the foregoing object, and which has an improved arrangement to facilitate mounting and adjustment of the rod corner bracket on a wall bracket.

Accordingly, the present invention provides a curtain rod and bracket assembly comprising at least one elongated rod member having a front wall and upper and lower U-shaped flanges extending lengthwise along a rear side of the front wall, corner bracket means having a generally upright rod support panel means and a generally upright mounting panel means extending rearwardly from the rod support panel means and integral therewith. The rod support panel means has a front face adapted to engage the rear side of the front wall of the rod member, and the rod support panel means has upper edge means and is constructed and arranged to extend into the upper flange on the rod member adjacent one end thereof and support the rod member for limited pivotal movement about the upper edge means toward and away from the front face of the rod support panel means. Latch means is provided on the rod support panel means below the upper edge means and is engageable with the rod member when the latter is pivoted about the upper edge means into engagement with the front face of the rod support panel for releasably retaining the rod member against pivotal movement away from the front face of the rod support panel. The latch means is advantageously formed integrally with the front face of the rod support panel and arranged to extend through a latch opening in the front wall of the rod member, to releasably latch the rod member to the front panel.

BRIEF DESCRIPTION OF THE DRAWINGS

FIG. 1 is a perspective view of a curtain rod and bracket assembly embodying the present invention;

FIG. 2 is a fragmentary perspective view illustrating assembly of the rod member on the rod corner brackets;

FIG. 3 is a fragmentary vertical sectional view taken on the plane 3—3 of FIG. 1;

FIG. 4 is a fragmentary horizontal sectional view taken on the plane 4—4 of FIG. 1 and illustrating the corner bracket disassembled from the mounting bracket;

FIG. 5 is a fragmentary sectional view taken on the plane 3—3 of FIG. 1 and illustrating parts on a larger scale; and FIG. 6 is a fragmentary sectional view taken on the plane 6—6 of FIG. 2.

DETAILED DESCRIPTION

The present invention relates to a wide face rod and end bracket assembly for supporting curtains, draperies, valances and the like, hereinafter generally referred to as a curtain rod and bracket assembly. The curtain rod can be formed of a single rod member for a fixed length curtain rod but is preferably composed of telescopically adjustable inner and outer rod members 11, 11' to enable adjustment of the overall length of the curtain rod. The inner and outer rod members 11, 11' are of like construction and each include a wide generally flat front wall 13 and upper and lower U-shaped flanges 14, 15 extending lengthwise along the rear side of the front wall. The rod members are preferably formed of sheet metal with roll formed flanges.

The rod members 11, 11' are supported adjacent opposite ends by left and right corner brackets designated 18, 18'. The left and right corner brackets are mirror images of each other, with small differences in size in some portions to correspond to the slightly different cross-sectional size of the inner and outer rod members, and like numerals are used to designate corresponding parts. The corner brackets have an L-shaped configuration and each include a generally upright rod support panel 21 and a generally upright mounting panel 22 extending laterally from one end of the rod support panel and formed integrally therewith. The corner brackets are preferably molded of synthetic resin material and may, for example, be formed of medium impact ABS. The rod support panel has a front face 21*a* adapted to engage the rear side of the front wall of the rod member and an upper edge means 21*b* that is constructed and arranged to extend into the upper flange 14 on the associated rod member adjacent one end. The rod support panel 21 is adapted to support the associated rod member for limited swinging movement about the upper edge means 21*b*, toward and away from the front face of the rod support panel. The lower edge 21*d* of the rod support panel is spaced below the upper edge a distance less than the spacing between the upper and lower flanges on the rod member, to provide clearance for the lower flange 15 on the rod member, during swinging of the rod member toward and away from the front panel. As best shown in FIG. 3, the upper U-shaped flange 14 on the rod member has a width somewhat greater than the thickness of the rod support panel 21, and a flange 21*c* is provided along the edge 21*b* at the rear side of the rod support panel, to engage the rear flange 14 and retain the upper portion of the rod member adjacent the front face of the rod support panel, when the rod member extends alongside the rod support panel.

A latch means is provided on the rod support panel 21 at a location spaced below the upper edge 21*b* and is arranged to engage the rod member when the latter is pivoted about the upper edge into engagement with the front face of the rod support panel, to releasably retain the rod member against pivotal movement away from the front face of the rod support panel. For this purpose, the rod members are each formed with a latch opening 31 at a location spaced below the upper flange 14 and inwardly of the end of the rod member, and latch means 32 are formed integrally with the rod support panel and extend forwardly from the front face 21*a* at a location to extend through the latch opening 31 and engage the rod member adjacent the opening, when the rod member is positioned alongside the rod support panel As best shown in FIG. 5, the latch means 32 advantageously comprise upper and lower latch members 32*a* and 32*b* formed integrally with the rod support panel 21 and arranged to engage upper and lower edges of the latch opening 31 in the rod member. A reinforcing rib 21*e* is provided at the rear side of the rod support panel 21 at a level adjacent the latch means 32 and arranged to extend to the mounting panel 22 to stiffen the rod support panel in the area of the latch means.

The curtain rod is adjustably mounted on wall brackets 41 adapted for attachment into a supporting surface such as a wall, window casing or the like. The wall brackets 41 are of like construction and each include a generally upright bracket plate 42 and a mounting flange 43 at one end of the bracket plate. The mounting flange has openings 43*a* for receiving fasteners to attach the mounting plate to a supporting surface such as a wall. The bracket plate 42 extends generally perpendicular to the wall and has parallel upper and lower edges 42*a*, 42*b* and upper and lower rows of spaced openings 42*c* and 42*d* paralleling the upper and lower edges. The mounting panels 22 of each corner bracket are adapted to overlie the outer side of the associated one of the bracket plates and the mounting panels have upper and lower L-shaped guide flanges 22*a* and 22*b* along their upper and lower edges arranged to engage the upper and lower edges of the bracket plate to guidably support the mounting panel on the bracket plate. The mounting panels each have a U-shaped slot 45 molded therein intermediate the upper and lower flanges 22*a*, 22*b* and which defines a tongue portion 46 that is integrally joined only at one end to the mounting panel. The tongue portion extends rearwardly on the mounting panel and is normally disposed coplanar therewith and the tongue portion has upper and lower bosses 46*a* and 46*b* that extend from the distal end of the tongue portion at the inner side of the mounting panel and which are adapted to engage a selected opening in the rows of openings 42*c*, 42*d*.

The tongue 46 is formed with a finger receiving tab 48 adjacent the distal end thereof and which projects from the outer side of the mounting panel, to enable pulling of the distal end of the tongue laterally outwardly relative to the mounting panel to disengage the bosses 46*a*, 46*b* from the openings in the bracket plate. The finger receiving tab 48 is advantageously formed so as to diverge rearwardly from the outer side of the tongue toward the distal end thereof to facilitate drawing the hem of a curtain rearwardly thereover, and the tab has its rear edge spaced outwardly from the outer face of the mounting panel to provide a finger receiving opening 48*a* at the rear end of the tab. Thus, a finger can be inserted into the opening 48*a* to engage the tab and move the distal end of the tongue laterally outwardly to disengage the bosses 46*a*, 46*b* from the openings in the bracket plate. The corner bracket can then be adjusted by pulling or pushing on the corner bracket. In order to facilitate assembly of the corner brackets on the wall brackets and also facilitate inward adjustment of the corner brackets, the bosses 46*a*, 46*b* are advantageously beveled or formed with a ramp portion best shown at 46*c* in FIG. 6, and so arranged that they will cam the bosses out of the openings in the row of openings in the bracket plate, when the corner bracket is pressed rearwardly relative to the bracket plate.

An intermediate support bracket 50 is advantageously provided, particularly for long curtain rods. The intermediate bracket has a wall mounting flange 52 and a rod engaging portion 53 that terminates in an upwardly opening hook (not shown) adapted to engage the upper flange on the rod members. The rod engaging portion 53 is adjustable as by a slot and fastener arrangement 54 to enable adjustment of the projection of the rod engaging portion.

From the foregoing it is thought that the construction and installation of the rod and bracket assembly will be readily understood. The wall brackets 41 and the intermediate bracket 51 are mounted on a supporting surface such as a wall, window casing or the like, and the corner brackets 18, 18' can then be assembled onto the bracket plates of the associated wall bracket. The curtain rod composed of telescoping rod members 11, 11' is initially adjusted lengthwise to the approximate finished length required. The rod is mounted from the front by first hooking the upper flange on the intermediate support bracket and thereafter resting the upper flange at the ends of the rod members on the upper edge 21*b* of the rod support panels 21, as shown in FIG. 2. The upper edges 21*b* of the rod support panels 21 provide relatively long support surfaces so that the rod members can be temporarily supported on the upper edges of the rod engaging panels and the rod members thereafter adjusted to the final desired length before the rod members are pressed rearwardly into engagement with the front face of the rod support panels. The latches 32 project through the latch openings 31 in the rod members and releasably retain the rod members against the front face of the rod support panel, and also inhibit upward and lengthwise movement of the rod members relative to the corner brackets. The mounting panels of the corner brackets extend across the end of the rod member when the latter is disposed alongside the rod support panel, and the end panel of each corner bracket is shaped to provide a shoulder at the end of the rod so that the outer surface of the corner bracket merges smoothly with the outer face of the rod at the front and top and bottom of the rod members.

The embodiments of the invention in which an exclusive property or privilege is claimed are defined as follows:

1. A curtain rod and bracket assembly comprising, at least one elongated rod member having a front wall and upper and lower U-shaped flanges extending lengthwise along a rear side of the front wall, corner bracket means having a generally upright rod support panel means and a generally upright mounting panel means extending rearwardly from the rod support panel means and integral therewith, the rod support panel means having a front face adapted to engage the rear side of the front wall of the rod member, the rod support panel means having upper edge means and being constructed and arranged to extend into the upper flange on the rod member adjacent one end thereof and support the rod member for pivotal movement about the upper edge means toward and away from the front face of the rod support panel means, latch means on the rod support panel means spaced below the upper edge means and engageable with the rod member when the latter is pivoted about the upper edge means into engagement with the front face of the rod support panel means for releasably retaining the rod member against pivotal movement away from the front face of the rod support panel means, and means for attaching the rod corner bracket means to a support surface.

2. A curtain rod and bracket assembly according to claim 1 wherein said rod member has a latch opening spaced below the upper flange and inwardly of one end of the rod member, said latch means engaging rod member at said latch opening.

3. A curtain rod and bracket assembly according to claim 1 wherein said rod member has a latch opening in said front wall spaced below the upper flange and inwardly of one end of the rod member, said latch means being integral with said rod support panel means and extending forwardly from the front face through said latch opening.

4. A curtain rod and bracket assembly according to claim 3 wherein said latch opening has upper and lower edges, said latch means including upper and lower latch elements integral with rod support panel means and respectively engageable with the upper and lower edges of the latch opening.

5. A curtain rod and bracket assembly according to claim 4 wherein the mounting panel of the corner bracket means overlies the end of the rod member when the front wall of the rod member engages the front face of support panel means.

6. A curtain rod and bracket assembly according to claim 1 wherein said means for attaching the rod corner bracket means to a support includes a wall bracket having a generally upright bracket plate and a mounting flange at one end of the bracket plate, the bracket plate having parallel upper and lower edges and a row of spaced openings paralleling said upper and lower edges, said mounting panel means having an inner side adapted to overlie the bracket plate and upper and lower guide means at its inner side engageable with the upper and lower edges of the bracket plate, the mounting panel means having a U-shaped slot therethrough intermediate said upper and lower guide means defining a tongue portion integrally joined only at one end to the mounting panel means and normally disposed generally coplanar with the mounting panel means, the tongue portion having at least one boss extending from the distal end of the tongue portion at the inner side of the mounting panel means for engagement with a selected opening in said row of openings, the tongue portion having a finger receiving tab adjacent the distal end thereof and projecting from the outer side of the mounting panel means for pulling distal end of the tongue portion laterally outwardly relative to the mounting panel means to disengage the boss from the openings in the bracket plate.

7. A curtain rod and bracket assembly according to claim 6 wherein said boss has a beveled end arranged to cam the distal end of the tongue portion out of an opening in the row of openings in the bracket plate when the corner bracket means is pressed rearwardly relative to the bracket plate.

8. A curtain rod and bracket assembly according to claim 6 wherein said finger receiving tab diverges rearwardly relative to a plane through the outer face of the mounting panel means and has a rear edge spaced outwardly of the outer face of the mounting panel means.

9. A curtain rod and bracket assembly comprising, at least one elongate-d -rod member having a front wall and upper and lower U-shaped flanges extending lengthwise along a rear side of the front wall, rod end bracket means having rod support means at a forward end thereof for supporting an end of the rod member and a mounting panel extending rearwardly from the rod support means and disposed in a generally upright plane transverse to the front wall of the rod member, a wall bracket having a mounting flange at a rear end attachable to a supporting surface and a bracket plate extending forwardly from the mounting flange and disposed in a generally upright plane, the bracket plate having parallel upper and lower edges and a row of spaced openings paralleling said upper and lower edges, said mounting panel having an inner side adapted to overlie the bracket plate and upper and lower guide means at its inner side guidably engaging the upper and lower edges of the bracket plate, the mounting panel having a slot of U-shaped configuration extending therethrough intermediate the upper and lower guide means defining a tongue portion integrally joined only at a forward end thereof to the mounting panel, the tongue portion having at least one boss extending from the distal end of the tongue portion at the inner side of the mounting panel for engagement with a selected opening in the row of openings, the tongue portion having a finger receiving tab adjacent the distal end thereof and projecting from the outer side of the mounting panel for pulling the distal end of the tongue portion laterally outwardly relative to the mounting panel to disengage the boss from the openings in the bracket plate.

10. A curtain rod and bracket assembly according to claim 9 wherein said finger receiving tab diverges rearwardly relative to the outer face of the outer side of the mounting panel.

11. A curtain rod and bracket assembly according to claim 9 wherein said finger receiving tab diverges rearwardly relative to the outer face of the mounting panel and has a rear edge spaced outwardly of the outer face of the mounting panel.

12. A curtain rod and bracket assembly according to claim 11 wherein the boss has a beveled end arranged to cam the distal end of the tongue portion out of an opening in the row of openings in the bracket plate when the rod end bracket means is pressed rearwardly relative to the bracket plate.

* * * * *